US005654042A

United States Patent [19]

Watanabe et al.

[11] Patent Number: 5,654,042

[45] Date of Patent: Aug. 5, 1997

[54] POWDER COATING SYSTEM FOR DIFFICULT TO HANDLE POWDERS

[75] Inventors: Takashi Watanabe, Oomiya; Kenichi Masuda, Tokyo; Shigeki Kasahara, Tokyo; Masashi Sakurazawa, Tokyo, all of Japan

[73] Assignee: Nordson Corporation, Westlake, Ohio

[21] Appl. No.: 481,292

[22] PCT Filed: Dec. 16, 1993

[86] PCT No.: PCT/US93/12391

§ 371 Date: Jun. 7, 1995

§ 102(e) Date: Jun. 7, 1995

[87] PCT Pub. No.: WO94/13405

PCT Pub. Date: Jun. 23, 1994

[30] Foreign Application Priority Data

| | | | |
|---|---|---|---|
| Dec. 17, 1992 | [JP] | Japan | 4-354685 |
| Mar. 3, 1993 | [JP] | Japan | 5-067634 |
| Apr. 5, 1993 | [JP] | Japan | 5-101894 |
| Apr. 21, 1993 | [JP] | Japan | 5-117841 |

[51] Int. Cl.[6] ..... B05D 1/06; B05B 7/14; B05C 11/10; B05C 13/02

[52] U.S. Cl. ..... 427/459; 427/185; 427/189; 427/475; 118/627; 118/699; 118/702; 118/DIG. 5

[58] Field of Search ..... 222/148; 239/697, 239/99, 112, 113; 118/302, 308, 699, 702, DIG. 5; 427/185, 459, 475, 190, 193, 189, 183

[56] References Cited

U.S. PATENT DOCUMENTS

| | | | |
|---|---|---|---|
| 4,109,027 | 8/1978 | Crose | 427/476 |
| 4,555,416 | 11/1985 | Fights et al. | 427/248.1 |
| 5,173,325 | 12/1992 | Knobbe et al. | 427/476 |
| 5,335,828 | 8/1994 | Kaiju et al. | 222/195 |
| 5,474,609 | 12/1995 | Mulder et al. | 118/308 |
| 5,520,735 | 5/1996 | Mulder | 118/308 |

*Primary Examiner*—Shrive Beck
*Assistant Examiner*—Fred J. Parker
*Attorney, Agent, or Firm*—Wood, Herron & Evans, L.L.P.

[57] ABSTRACT

A powder coating system for difficult to handle powders includes a powder hopper containing fluidized powder particles, a pump body connected to the hopper and having an inlet in communication with the hopper, an ejector nozzle mounted to the pump body and aimed at an outlet thereof, a second nozzle mounted to the pump body and aimed at the inlet thereof and a powder application device for receiving powder particles from the outlet of the pump body and spraying them onto an article to be coated. The ejector nozzle sprays pressurized air toward the outlet to transport powder particles along a flow path which extends from the powder hopper into the pump body via the inlet and then out of the pump body via the outlet. The second nozzle sprays air pulses at the inlet in a direction opposite the particle flow along the flow path caused by the ejector nozzle. This spray from the second nozzle creates microvibrations in the inlet of the pump body to eliminate powder particle adherence and cohesion thereat. The pump body may have separate, spaced intake and ejector portions, with the ejector nozzle mounted in the ejection portion and the second nozzle mounted on the intake portion.

44 Claims, 6 Drawing Sheets

POWDER COATING SYSTEM FOR DIFFICULT TO HANDLE POWDERS

FIELD OF THE INVENTION

This invention relates to an improved method and apparatus for the gas transport of powder, and more particularly, to methods and apparatus which assure delivery of uniform and consistent quantities of powder per unit time to a spray gun for application to the surface of an article to be coated.

BACKGROUND OF THE INVENTION

In a typical powder coating apparatus, powder is maintained in a fluidized state within a hopper having a fluidized bed, and is transported from the hopper to a pump chamber of a powder pump, whereupon an ejector nozzle in the pump directs a high pressure gas stream toward an outlet of the chamber and along an exit tube connected to the chamber. As a result, the powder is conveyed through the exit tube to a spray gun which sprays the powder toward the surface of an article to be coated. The ejector nozzle must be operated at sufficiently high pressure to transport the particles to the end of the exit tube and through the spray gun. During this pumping operation, the high pressure oft he ejector nozzle creates a relatively low pressure at the intake to the pump chamber, thereby drawing powder particles from the powder container and into the chamber for ejection therefrom along the exit tube.

One typical application for an apparatus of this type involves coating the surface of an aluminum joint with powdered solder flux prior to steps of heating and melting the solder flux to weld the connecting aluminum elements and form the joint. The reliability of the connection depends upon the uniformity of the flux coating.

In these and other applications wherein powder particles are gas-transported to coat a surface, including applications which involve electrostatic charging of the particles, problems may result due to adherence and accumulation of the powder particles at the inlet of the pump from the hopper. This occurs with powders that have the property of relatively easy coherence, easy adherence due to viscosity, relatively low slipperiness, or powders which simply do not have good flow characteristics and tend to agglomerate. Powdered solder flux is such a powder. With these types of powders, even powder flow from the hopper to the spray gun is difficult to achieve, and therefore, the amount of powder transported per unit time fluctuates. As a result, it is difficult when spraying these powders to achieve a uniformly thick coating of powder on the article and to consistently apply a uniform coating from one article to the next in a production line situation. This is possibly due to changes in the flow of the powder resulting from a reduction in the cross sectional area at the inlet to the pump or because of the influence of static electricity among the particles due to friction which encourages agglomeration of the powder particles.

It is therefore one objective of the invention to achieve greater uniformity in powder transport per unit time by minimizing or reducing accumulation and adherence of the particles during transport from the powder hopper to the article to be coated.

In other applications for powder coating via gas transport, it is often necessary to intermittently turn the powder pump on and off. One example for the need of this type of operation involves coating articles carried on a conveyor, wherein it is desirable to spray coat the articles at a coating station on the conveyor, and then turn the pump off until the conveyor moves the next article to the coating station. For applications which require ON/OFF operation of a powder coating apparatus, it is desirable to achieve precise control of the powder flow to effectively turn the apparatus off and on at the desired times. Otherwise, powder is wasted. It is also desirable to spray the same quantity of powder on each article.

In the past, pinch valves made of rubber tubes have been used to control intermittent powder flow at a powder hopper. Rubberized pinch valves are pneumatically operated and are relatively simple and inexpensive. However, during closing, these valves have a tendency to close upon some powder particles. Eventually this causes gaps between the opposing rubber portions and produces air leaks. These leaks allow some powder to move to the downstream side of the pinch valve. Because there is no way of knowing how much powder has reached the downstream side of the pinch valve, the amount of powder ejected during each ON/OFF cycle may vary. This will produce nonuniformity in coating an article. Additionally, after a certain number of switching operations, the rubber of the pinch valve becomes fatigued and it deteriorates to a point where it is impossible to use. Again, as this occurs, the effectiveness of the valve becomes questionable. As varying quantities of powder reach the downstream side, the apparatus will eject varying quantities of powder during each ON/OFF cycle.

It is another objective of this invention to more precisely control the ON/OFF switching operation of a powder pump, thereby to assure delivery of uniform powder quantities during each ON/OFF cycle of operation.

It is still another objective of the invention to simultaneously achieve uniform powder ejection per unit time during an ON cycle and to effectively stop and start powder ejection during switching operation between ON/OFF and OFF/ON, respectively.

It is still another objective of the invention to minimize the adverse effects of powder cohesion, adherence, agglomeration and friction during flow from a fluidized powder hopper to an outlet end of a spray gun, thereby to achieve improved uniformity in powder delivery to an article to be coated and to produce a more stable coating thereon.

SUMMARY OF THE INVENTION

The above-stated objectives related to improved uniformity in powder delivery during operation are achieved by directing low pressure gas pulses toward the fluidized powder hopper, counter to the normal flow direction of the powder out of the hopper, thereby to create microvibrations within the powder intake portion of the ejector pump body and eliminate adherence and cohesion among powder particles at the pump inlet. These low pressure gas pulses are produced during the ON cycle of the pump.

The above-stated objectives related to improved control over the ON/OFF switching operation for a powder pump are achieved by directing a reverse flow of gas through the powder pump inlet toward the fluidized hopper and counter to the normal flow direction of the powder, at a pressure sufficient to prevent particles from entering the pump inlet during the OFF cycle. For both the low pressure reverse direction pulses provided during the ON cycle, and higher pressure reverse air flow provided during the OFF cycle, the nozzle or nozzles which create these air flows are oriented such that the axes of these spray nozzles do not intersect the axis of the ejector nozzle, and the flow paths of the air flows produced by these nozzles do not cross with the flow path of the ejector nozzle air flow.

According to a first preferred embodiment of the invention, a powder ejection apparatus includes a fluidized powder container, a pump body with a pump inlet in communication with the powder container and an outlet for directing the powder to an article to be coated, an ejector nozzle for directing high pressure air through the pump body toward the outlet and a reverse pulse nozzle directed at the pump inlet. Preferably, the nozzles are oriented such that their spray paths do not intersect.

When the ejector nozzle is operated at a relatively high pressure, powder is transported from the pump body through the outlet. Low pressure at the powder intake portion created by the ejector nozzle causes powder to flow therethrough from the powder hopper for subsequent ejection. While the ejector nozzle operates, the reverse pulsing nozzle also operates at a relatively low pressure, and is pulsed off and on intermittently at high frequency to cause microvibrations of powder particles within the powder intake portion. This prevents adherence and accumulation of powder particles to the side walls of the powder intake portion, and thereby produces a uniformity in powder flow through the apparatus per unit time. As a result, more uniform coating of an article may be achieved.

According to a second preferred embodiment of the invention, more precise control of the switching operation between OFF and ON, and vice versa, is achieved via the use of a reverse flow nozzle adapted to spray powder back into the powder hopper when the ejector nozzle is off. When the ejector nozzle switches back on, the reverse flow nozzle turns off. Each time the ejector nozzle is turned on, the powder must traverse the entire flow path from the powder hopper to the outlet of the powder ejection apparatus, because the reverse flow nozzle had previously blown all the powder within the hopper outlet back into the powder hopper. This assures consistency in powder delivery during the ON cycle of the apparatus.

This embodiment of the invention represents an improvement over prior pinch valves located between the hopper and the pump, which are subject to wear over a period of time and inconsistent performance, due to leakage of powder therethrough. With this embodiment, no powder resides in the pump body prior to turning the ejection nozzle back on.

In one variation of the second preferred embodiment of the invention, the ejector nozzle and reverse flow nozzle are mounted to separate bodies which are interconnected via a connector line. In another variation, the ejector nozzle and the reverse flow nozzle are mounted to the same body and oriented such that their spray paths do not intersect.

A third preferred embodiment of the invention provides the advantages of both the first and second embodiments by utilizing a single nozzle to provide reverse pulsing during the pump ON cycle and reverse flow to switch the apparatus OFF at the end of the ON cycle. This nozzle is fed by two separate fluid lines, each with a separate solenoid valve. Operation of the valves is controlled by an electrical controller which also controls operation of the flow of fluidizing air for the powder hopper, ejector air for the ejector nozzle and transport air injected by a transport nozzle located downstream of the ejector nozzle. Powder delivered by this embodiment of the powder ejection apparatus is carried by an air stream which comprises the confluence of the air from the ejector nozzle and the air from the transport nozzle.

With this embodiment, precise switching is achieved to more effectively turn the apparatus OFF and ON when desired, and vice versa, and in a manner which assures consistent delivery of powder at the beginning of the next ON cycle. Additionally, due to the use of pulsing operation during powder ejection, uniformity in powder delivery is achieved during the ON cycle. Preferably, the controller also controls delivery of powder to the hopper, as needed, and controls rotation of a stirring blade within the hopper to minimize channeling of powder, or the formation of chimneys of air in the powder within the hopper, an effect which may result from vertical air jets from the fluidizing plate being undisturbed or uninterrupted for an extended period of time. With the third embodiment, the powder intake portion extends through the bottom of the powder hopper, and the pump body for the powder ejection apparatus is connected directly to the bottom of the powder hopper.

According to a fourth preferred embodiment of the invention, precise powder flow control is achieved during pumping and during switching in a matter similar to the third preferred embodiment. Additionally, the fourth embodiment uses a reduced diameter stirring paddle located directly above the powder intake portion of the apparatus. The powder intake, or inlet, extends through the bottom of the powder hopper and into a pump body located therebelow. As with the third embodiment, in the fourth embodiment powder is pumped via operation of an ejector nozzle directed toward an outlet line. Use of a transport air nozzle is optional. During the off cycle, reverse air flow is used to prevent powder particles from flowing downwardly from the powder container into the powder inlet of the apparatus. Additionally, the outlet line extends horizontally from the pump body, without any upward turns, and connects to a gun at its outlet end, which is directed vertically. With this construction, powder does not fall back into the pump body due to gravitational forces during the off cycle. Additionally, with this construction interaction among the powder particles which produces accumulation, adherence, agglomeration and/or static electricity from friction is reduced, thereby enhancing the uniformity of powder delivery to an article to be coated and producing a more stable coating.

Optimally, the spray gun utilized in this fourth embodiment, and the other embodiments as well, has a straight, unobstructed flow path with an external charging electrode to prevent powder particles from agglomerating within the spray gun.

These and other features of the invention will be more readily understood in view of the following detailed description and the drawings.

DETAILED DESCRIPTION OF THE PREFERRED EMBODIMENTS

Figure 1:
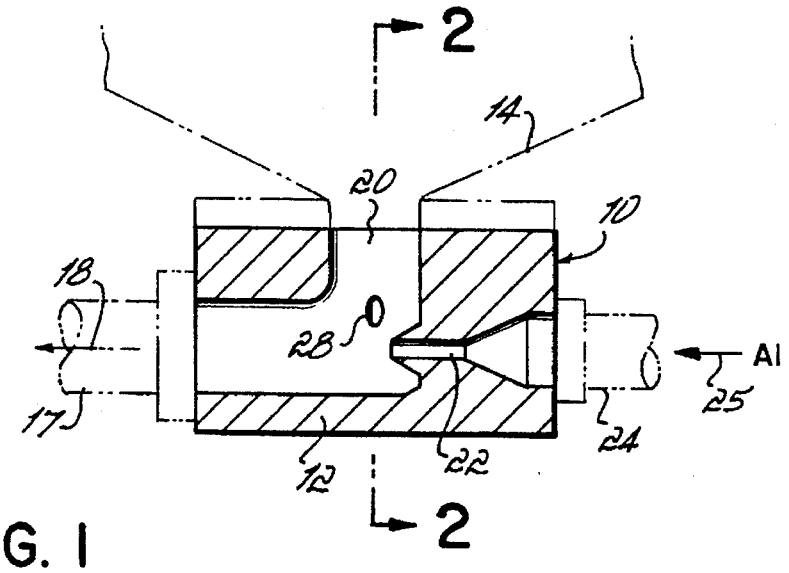
FIG. 1 is a vertical cross sectional view of a powder ejection apparatus constructed in accordance with a first preferred embodiment of the invention.
Figure 2:
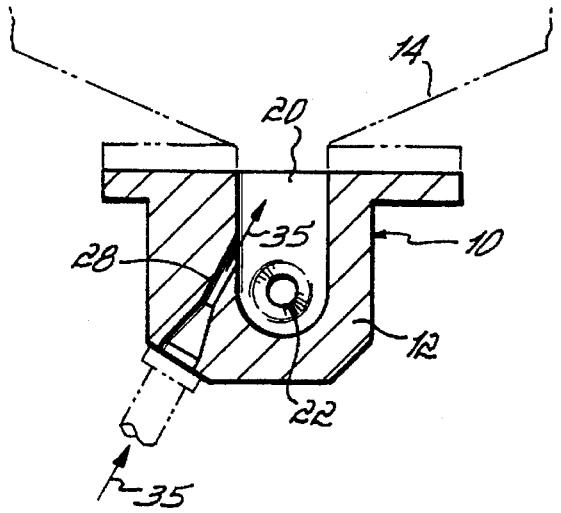
FIG. 2 is a cross sectional view taken along lines 2—2 of FIG. 1.
Figure 3:
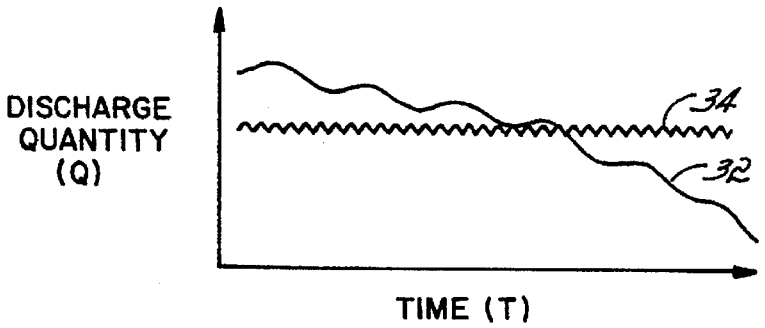
FIG. 3 is a graph which depicts powder discharge rate for the powder ejection apparatus shown in FIGS. 1 and 2.

FIGS. 1–3 relate to a first preferred embodiment of the invention. More particularly, FIG. 1 shows a powder ejection apparatus 10 which includes a pump body 12. The pump body 12 receives fluidized powder from a powder hopper 14 and pumps the powder through an ejection tube 17 connected to the pump body 12. Directional arrow 18 shows the direction of flow of the powder. The tube 17 may be of any desired length to facilitate directing the powder flow to a spray gun. To enter pump body 12 from the power hopper 14, the powder enters a powder inlet 20. This powder flow is caused by an ejector nozzle 22 mounted to pump body 12 and directed along the same axis as tube 17. An air supply tube 24 is connected to ejector nozzle 22, and as shown by directional arrow 25, supplies air at a relatively high pressure to ejector nozzle 22 to pump the powder outwardly through tube 17. As ejector nozzle 22 directs the high pressure air stream toward tube 17, a low pressure is created at the powder inlet portion 20, thereby causing the powder to move therethrough from the hopper 14 and into the pump body 12 to be pumped through tube 17.

Because of the relatively small cross sectional dimension of inlet 20 relative to powder hopper 14, powder has a tendency to adhere and accumulate within the inlet 20 enroute to pump body 12, particularly if the powder has the property of high coherence, high adherence due to viscosity, low slipperiness, a tendency to agglomerate or low flow characteristics. If left unchecked, this powder accumulation will narrow the powder inlet 20 and reduce the total volume of powder supplied to the pump body 12 and to tube 17 per unit time, thereby adversely affecting the uniformity of the powder coating on the article being coated. This reduction in discharge quantity per unit time is shown in FIG. 3, designated by reference numeral 32.

To solve this problem, a pulsing air flow is directed from a pulsing nozzle 28 through the inlet 20 in a direction counter to that of the normal powder flow inlet 20. Preferably, as shown in FIG. 2, the nozzle 28 and the nozzle 22 are oriented such that their axes and flow paths do not intersect. Also, it is preferred that this reverse flow be sprayed at a pressure lower than the pressure of the air sprayed from nozzle 22. This pulsing air flow from nozzle 28 produces microvibrations in the powder within the inlet 20, which prevents or reduces adherence and accumulation of the powder along the sidewalls thereof. As a result, the quantity of powder transferred from the hopper 14 through the pump body 12 and outwardly through tube 17 does not fluctuate with time during operation of the powder ejection apparatus 10. Therefore, the powder ejection apparatus 10 can be operated continuously to produce uniformity in the volume of powder ejected per unit time, thereby assuring consistent powder flow to a spray gun for spraying onto a surface to be coated and producing a higher quality coating.

EXAMPLE NO. 1

Applicant tested powder ejection apparatus 10 using the following parameters:

Powder used—a fluoride powder flux;

Air pressure setting for the ejector nozzle 22—4 kg/cm$^2$;

Air pressure setting for nozzle 28—2 kg/cm$^2$, and the air was continuously pulsed to spray for a duration of about 20 to 100 milliseconds and then to stop for a duration of about 40 to 200 milliseconds.

Under these conditions, the powder ejection apparatus 10 ejected the fluoride powder in a relatively uniform quantity over the entire period of operation, as shown in FIG. 3 by reference numeral 34, thereby improving the powder flow uniformity.

While FIGS. 1 and 2 show nozzle 28 above and to the side of ejector nozzle 22, it is to be understood that nozzle 28 could be located in any one of a number of different positions, so long as the oppositely directed pulsing air flows through inlet 20 and into powder hopper 14. The primary consideration is that the two gas flows from nozzles 22 and 28 should not cross. Also, the powder hopper 14 may be a fluidizing tank for supporting the powder in a fluidized state, i.e., a fluidized bed.

Figure 4:
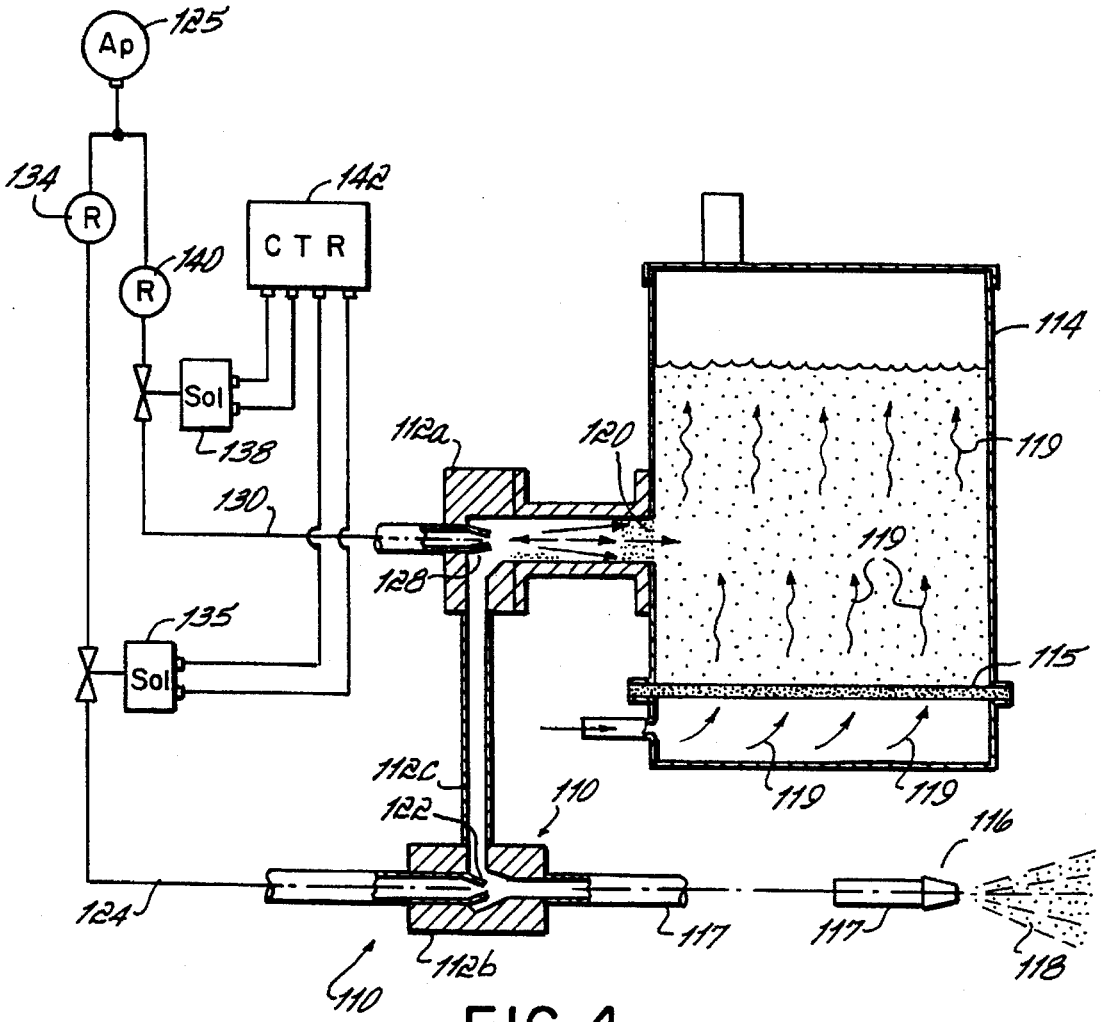
FIG. 4 is a vertical cross sectional view of a powder ejection apparatus constructed in accordance with a second preferred embodiment of the invention.

FIGS. 4–7 relate to a second preferred embodiment of the invention. More particularly, FIG. 4 shows a powder ejection apparatus and powder coating system 110 which also provides uniformity in volume and consistency for a powder coating, but in a slightly different manner. The apparatus 110 receives fluidized powder from a powder hopper 114 and pumps the powder to a spray nozzle 116 located at the end of an outlet tube 117. The powder storage chamber 114 includes a fluiding plate 115 located adjacent the bottom thereof through which air is directed upwardly, as shown by directional arrows 119, to fluidize the powder within hopper 114. Similar to the first embodiment, pressurized air is sprayed from an ejector nozzle 122 aimed along the axis of the tube 117. However, in this second embodiment, instead of a single pump body 12, the powder ejection apparatus 110 has a pump body which includes a separate intake portion 112*a* and an ejector portion 112*b* in fluid communication via a connector 112*c*. The intake portion 112*a* is in fluid communication with the powder hopper 114, thereby providing a flow path for fluidized powder from the powder hopper 114 to the ejector portion 112*b*. More particularly, intake portion 112*a* includes powder inlet portion 120 through which the powder must flow from powder hopper 114 enroute to the ejector portion 112*b*. A reverse flow nozzle 128 mounts to intake portion 112*a*, and is directed toward powder inlet 120 to spray air through the powder inlet 120 and into the powder hopper 114, counter to the normal flow direction of the powder.

Ejector nozzle 122 and reverse flow nozzle 128 are operatively connected to a pressurized air source 125, via fluid lines 124 and 130, respectively. Fluid lines 124 and 130 each include an in line gas regulator, designated by reference numerals 134 and 140, respectively. Additionally, fluid lines 124 and 130 include solenoid valves 135 and 138, respectively, which are electrically connected with an electric controller 142. The controller 142 controls the timing sequences of the operation for the ejector nozzle 122 and the reverse flow nozzle 128 to alternately actuate the solenoid valves 135 and 138 to spray air from nozzles 122 and 128, thereby alternating between drawing powder into powder ejection apparatus 110 from hopper 114 and blowing powder away from apparatus 110 into hopper 114.

Thus, compared to the first embodiment, which produced uniformity in powder quantity per unit time during ejection, this embodiment achieves uniformity in ejection quantity per ON/OFF cycle. This is due to the uniformity in conditions during initiation of the "ON" portion of the ON/OFF cycle of operation. At initiation, no powder resides in the inlet portion 120, unlike prior systems which relied upon pinch valves and were susceptible to deterioration with age and inadvertent powder flow. Preferably, the controller 140 is programmable to select the desired operating sequence.

During operation, when the ejector nozzle 122 sprays air through ejector portion 112*b*, reduced pressure at inlet 120 and in connector tube 112*c* causes the fluidized powder to flow from the powder hopper 114 through powder intake portion 120 and ejector portion 112*b* to nozzle 116. This produces a spray pattern 118 of powder coating material from nozzle 116. After the nozzle 122 turns off, reverse flow nozzle 128 is turned on to spray air toward hopper 114, and in the opposite direction of the normal powder ejection flow path of the fluidized powder. This spray from nozzle 128 blows the powder out of the inlet portion 120 into the chamber 114. When nozzle 128 is turned off and nozzle 122 is turned on, the powder must move entirely from the chamber 114 to inlet 120, since no powder was already in the inlet 120 at the commencement of spraying by nozzle 122. By cooperatively pulsing the ejector nozzle 122 and the reverse flow nozzle 128, the same quantity of powder can be ejected during each cycle of "ON/OF" sequences, thereby assuring uniformity in powder ejection during coating operations which require switching and eliminating prior uniformity problems caused by inconsistent spray volumes especially during initiation of the "ON" portion of the cycle. This second embodiment of the invention is particularly suitable for spray coating articles carried a conveyor, due to the need for ON/OFF cycling at a coating station.

Figure 5:
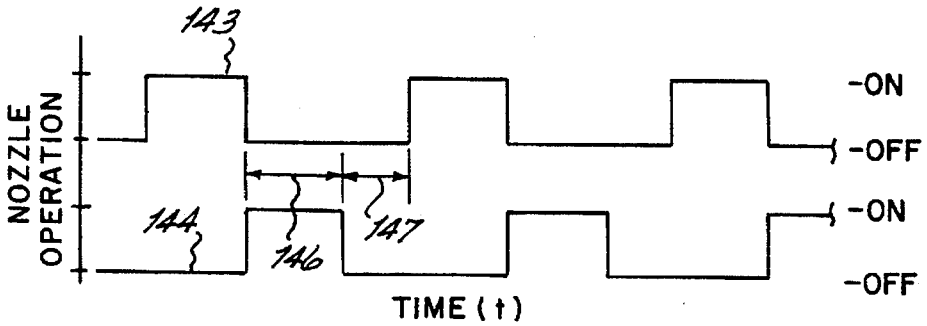
FIG. 5 is a graph which illustrates operation of the ejector nozzle and the reverse flow nozzle of the powder ejection apparatus shown in FIG. 4.

FIG. 5 shows the ON/OFF times for ejector nozzle 122 and reverse flow nozzle 128, as designated by reference numerals 143 and 144, respectively. Reference 146 shows the duration of "ON" time for reverse flow air nozzle 128 and reference numeral 147 shows the duration of time thereafter until ejector nozzle 122 is turned back to "on" to commence powder pumping. Thus, no powder is pumped during the time period represented by the sum of 146 and 147.

With the reverse flow of air sprayed by nozzle 128 through powder inlet portion 120, this invention eliminates the need to insert a pinch valve, or possibly a mechanical type valve, between powder hopper 114 and the inlet of ejector portion 112*b* for the purpose of starting and stopping powder flow.

Figure 6:
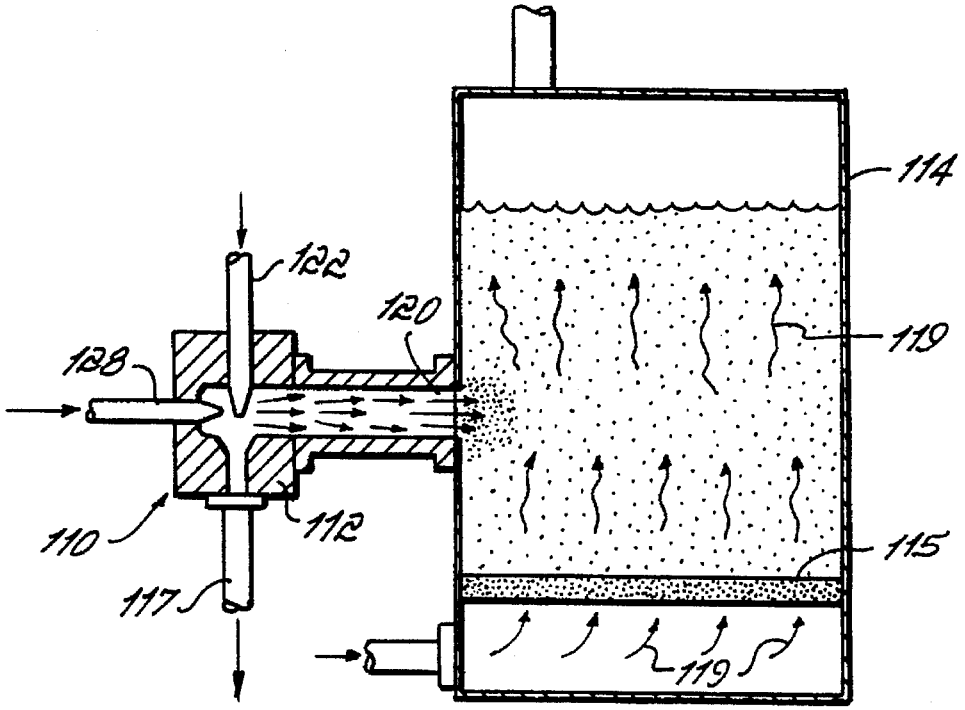
FIG. 6 is a vertical cross section, similar to FIG. 4, of a variation of the second preferred embodiment of the invention.

FIG. 6 shows a variation of the second preferred embodiment of the invention. According to this variation, the powder ejection apparatus 110 includes a single piece pump body 112 to which the ejector nozzle 122 and the reverse flow nozzle 128 are mounted. The ejector nozzle 122 is aimed to spray air outwardly through line 117, and the reverse flow nozzle 128 is aimed to spray air opposite the normal flow of the fluidized powder, through powder inlet 120 and toward powder hopper 114.

Figure 7:
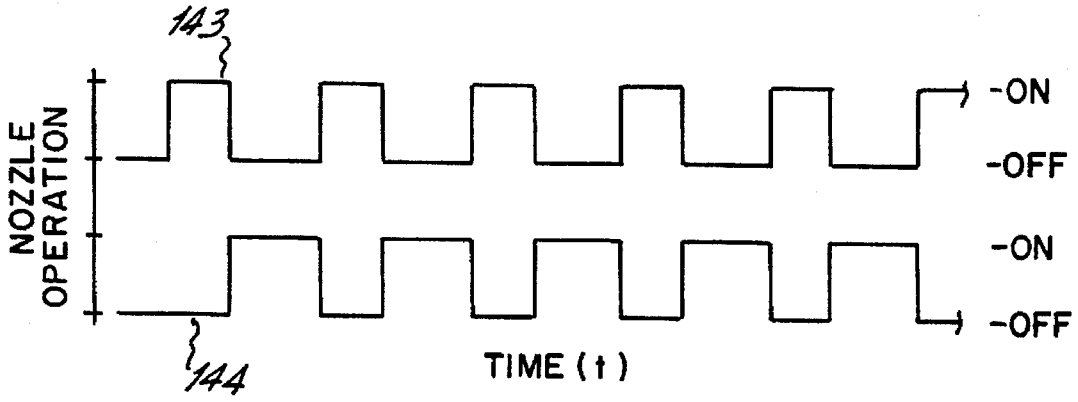
FIG. 7 is a graph which illustrates operation of the ejection nozzle and the reverse flow nozzle of the powder ejection apparatus shown in FIG. 6.

FIG. 7 shows timing control for switching the operation of ejector nozzle 122 and the reverse flow nozzle 128 for the apparatus 110 shown in FIG. 6. Because of the proximity of the nozzles 122 and 128, the switching spray pulses between ON/OFF can be more closely timed to provide a shorter ON/OFF cycle for the apparatus 110. Again, as with the apparatus shown in FIG. 4, the apparatus of FIG. 6 provides effective stopping and starting of each powder pumping cycle, thereby assuring uniformity in the volume of powder pumped per cycle.

Figure 8:
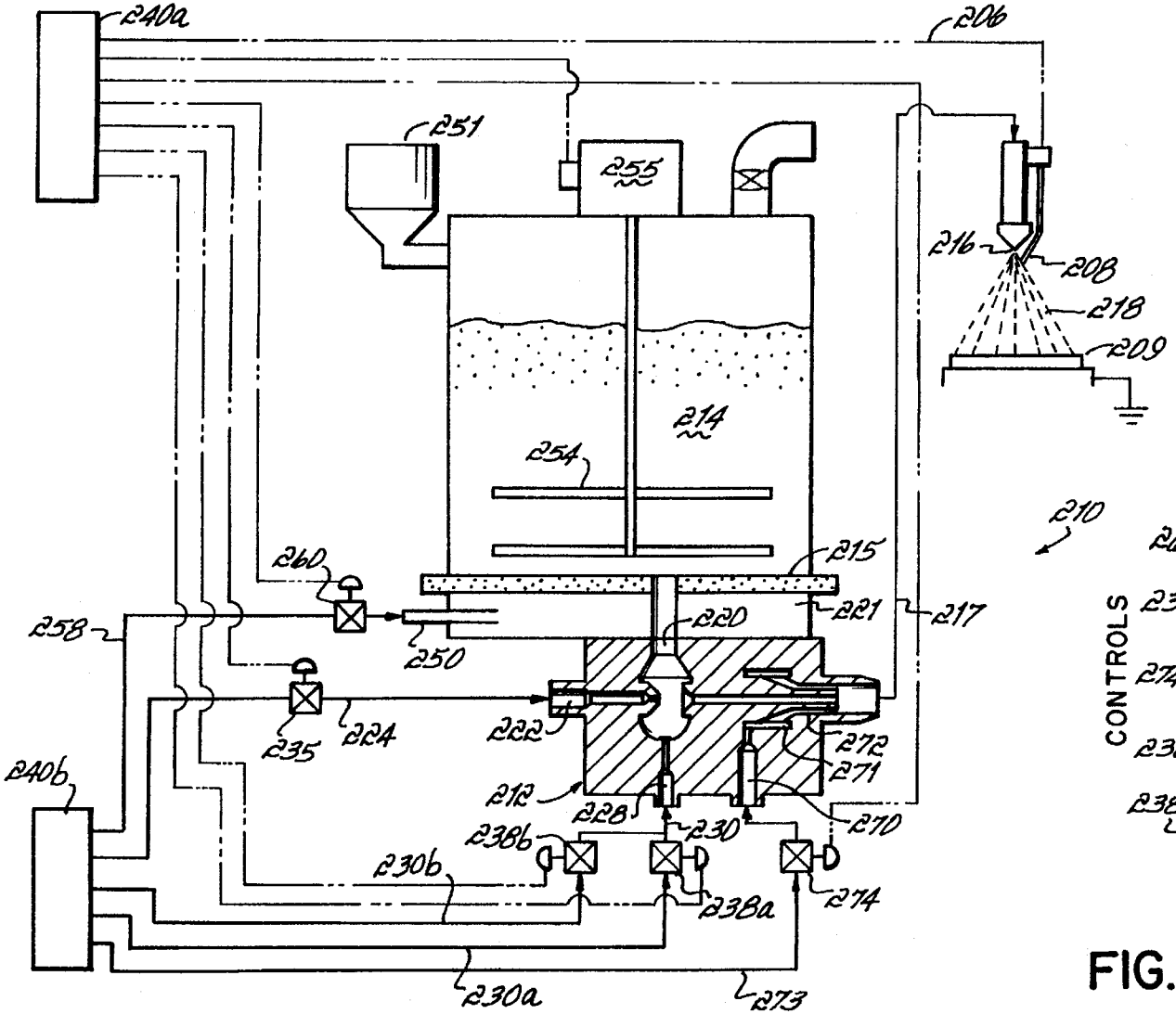
FIG. 8 is a cross sectional schematic view of a powder coating system constructed in accordance with a third preferred embodiment of the invention.
Figure 9:
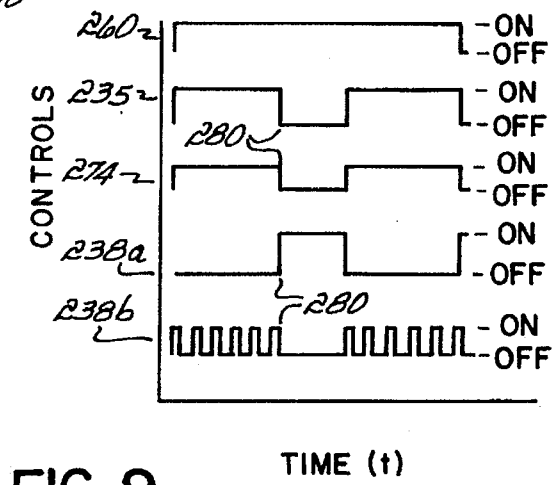
FIG. 9 is a graph which illustrates the operation of the powder coating system shown in FIG. 8.

FIGS. 8 and 9 depict a third preferred embodiment of the invention which combines features from the first and the second embodiments. More specifically, FIG. 8 shows a powder coating system 210 for applying electrostatically charged particles to an article 209 to be coated. The apparatus 210 conveys the particles through an outlet conduit 217 to a spray nozzle 216 which produces a spray pattern designated by reference numeral 218. To electrostatically charge the particles, the apparatus 210 includes a corona electrode 208 mounted adjacent the outlet 216. The corona electrode 208 is connected to a power supply (now shown) in electrical controller 248 via an electrical cable 206.

The system 210 further includes a pump body 212 which receives powder from a powder hopper 214 and then conveys the powder to outlet conduit 217. The hopper 214 includes a fluidizing plate 215, located at a bottom end thereof above a fluidizing air plenum 221. An air inlet 250 supplies pressurized air to the plenum 221, and a resulting upward flow of the pressurized air through the plate 215 causes the powder to be fluidized. A powder supply container 251 supplies powder to the hopper 214 in response to a level sensor (now shown) in a manner known in the industry. The hopper 214 also includes a rotatable stirring blade 254 which is driven by a motor 255. The stirring blade 254 reduces channeling of the powder in the hopper 214, as described above.

Air to the inlet nozzle 250 is supplied via a line 258 connected to a pressurized air supply source and controller, designated generally 240*b*, and the system 210 precisely controls the flow of air to inlet 250 via a solenoid valve 260, which is electrically controlled by an electrical controller 240*a*. The electrical controller 240*a* and the air supply source and controller 240*b* cooperatively interact to control all operations of the powder system 210. Preferably, each of the controllers 240*a* and 240*b* includes a microprocessor to facilitate programmable control.

The pump body 212 is connected to the bottom of the hopper 214 and includes a powder inlet 220 which communicates with the hopper 214. A reverse flow nozzle 228 mounts to pump body 212 for directing a stream of air through the powder inlet 220 and toward the hopper 214, opposite the normal flow direction of powder during pump operation. An ejector nozzle 222 also mounts to the pump body 212, and ejector nozzle 222 delivers a high pressure air stream through the pump body 212 along the axis of outlet line 217. Additionally, pump body 212 includes a gas transport nozzle 270 which supplies pressurized gas to an annular region 271 within the pump body 212 and then toward outlet line 217 via channels 272, which are also formed within the pump body 212. Thus, the transport nozzle 270 supplies pressurized transport air downstream of the ejector air supplied by the ejector nozzle 222. As a result, powder pumped from pump body 212 and into line 217 is carried by an air stream consisting of the confluence of the ejector air and the transport air.

Air transport nozzle 270 is supplied with pressurized air via a fluid line 273 connected to the controller 240*b*, and air flow is controlled via a solenoid valve 274, which is electrically connected to controller 240*a*. Similarly, ejector nozzle 222 is connected to controller 240*b* via a fluid line 224, and ejector air flow is controlled via a solenoid valve 235 which is electrically connected to electrical controller 240*a*.

In this embodiment, the reverse flow nozzle 228 includes two separate fluid supply lines 230*a* and 230*b* connected to controller 240*b*, through which air flow is controlled by solenoid valves 238*a* and 238*b*, respectively. Downstream of the solenoid valves 238*a* and 238*b*, the lines 230*a* and 230*b* merge to form a single air supply line 230 for nozzle 228. The use of two separate supply lines 230*a* and 230*b* and two separate solenoid valves 238*a* and 238*b* allows the apparatus 210 to use a single nozzle 228 for providing reverse pulsing during powder pumping, as in the first embodiment, and reverse flow to stop powder from entering pump inlet 220 when the pump 15 is idle, as in the second embodiment.

In operation, at start-up, solenoid valves 235, 274 and 238*b* are closed. Solenoid valves 260 and 238*a* are opened. This produces fluidizing air flow into fluidizing plenum 221 via hopper inlet 250 to fluidize particles in the hopper 214. Additionally, the reverse flow through nozzle 228 prevents powder from entering the powder inlet 220. The pressure of the air supply sprayed from nozzle 228 may initially need to be adjusted to accomplish this objective by means of a regulator (now shown). Additionally, the stirring blade 254 is rotated by means of motor 255. Solenoid valve 260 remains open so that powder is continuously fluidized during the operation of system 210, and likewise blades 254 are at all time continuously rotating wherever the system 210 is in operation. To spray powder, valves 235 and 274 are opened, and solenoid valve 238*a* is closed. This causes nozzle 222 and nozzle 270 to spray ejector air and transport air, respectively, thereby causing powder to be pumped from hopper 214 through pump body 212 to outlet line 217.

At the same time, solenoid valve 238*b* is opened and closed intermittently (pulsed) based on an electrical signal from the controller 240*a*. Preferably, during this intermittent opening and closing of valve 238*b*, the air sprayed into pump body 212 from nozzle 228 is adjusted to a pressure lower than the pressure of the pressurized air sprayed from the ejector nozzle 222. Valve 238*b* continues to cycle for so long as solenoid valves 235 and 274 are open. With the ejector nozzle 222 spraying air, due to opening of solenoid valve 235, powder from the hopper 214 is drawn into pump body 212 through powder inlet 220 via venturi operation. Additionally, due to the opening of solenoid valve 274, transport nozzle 270 supplies pressurized transport air to the pump body 212 downstream of ejector nozzle 222. As a result, powder particles are pumped through line 217 and are sprayed outwardly from nozzle 216, whereupon corona electrode 208, powdered by cable 206 via power supply and controller 204*a*, electrostatically charges the particles to render them electrostatically attracted to the article 209 to be coated. Article 209 is typically electrically grounded by the conveyor.

To temporarily stop the flow of powder from the nozzle 216, valves, 235, 274 and 238*b* are closed, and at the same time, valve 238*a* is opened. This causes air flow from nozzle 228 to go from the intermittent pulsing operation at relatively low pressure to reverse flow operation wherein an air stream is sprayed at sufficient pressure to force the powder particles in the powder inlet 220 back into the hopper 214. This operation of the solenoid valves is shown more clearly in FIG. 9, with reference numeral 280 indicating a temporary stoppage of powder flow.

With this powder coating system 210, a very consistent powder coating may be applied to an article 209, with a uniformity of powder thickness and high quality assured, due to improved control of the volume of powder delivered per unit time during the "ON" portion of the ON/OFF cycle of operation and the ability to temporarily halt flow of the powder from the hopper 214 during switching between "ON" and "OFF". This assures uniformity in conditions each time the powder pump of system 210 is switched "ON".

EXAMPLE 2

A high quality coating was achieved with powder coating system 210 using the following parameters:

Powder—fluoride powder flux;

Rotation frequency of stirring blade—60 rpm;

Pressurized air for fluidization inlet 250—2 kg/cm$^2$;

Pressurized air for ejector nozzle 222—4 kg/cm$^2$;

Pulsed air flow for nozzle 228/solenoid valve 238*b*—2 kg/cm$^2$ with pulsed "ON" time of about 20–100 milliseconds and "OFF" time of about 40–200 milliseconds;

Reverse flow air for nozzle 228/solenoid valve 238*a*—3 kg/cm$^2$;

Pressurized air for transport Nozzle 270—2–3 kg/cm$^2$.

Figures 10, 10A:
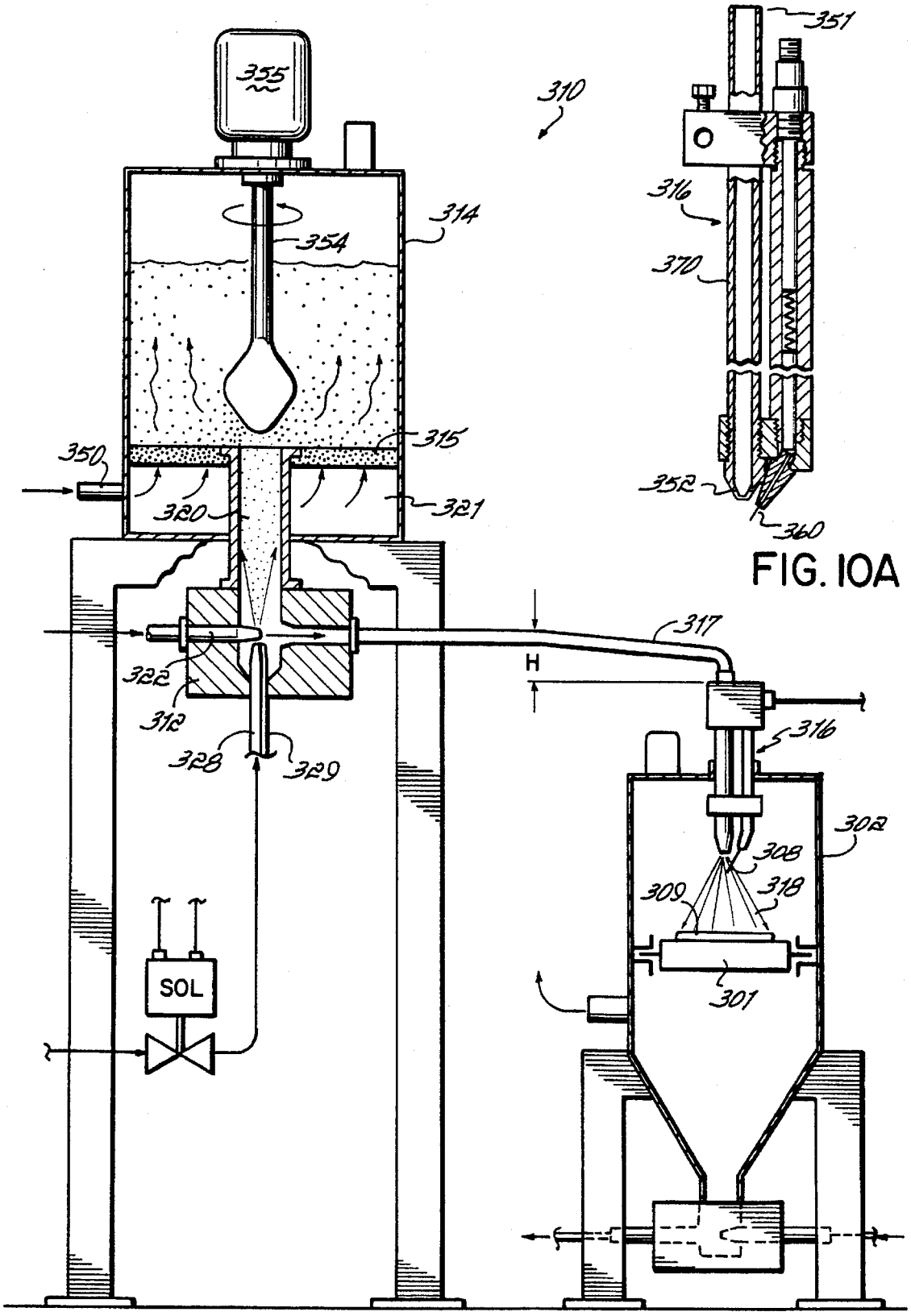
FIG. 10 is a cross sectional schematic view of a powder coating system constructed in accordance with a fourth preferred embodiment of the invention.
FIG. 10A shows the powder coating gun of FIG. 10 in more detail.
Figure 11:
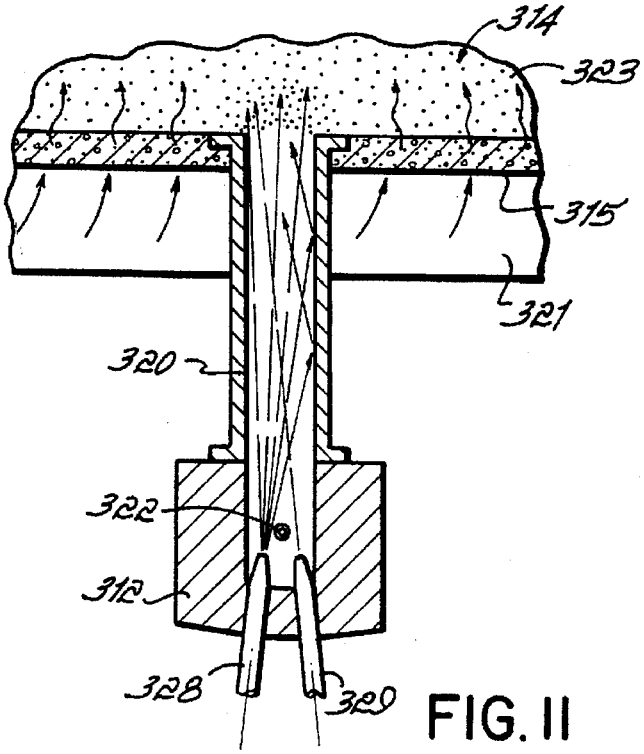
FIG. 11 is a cross sectional view taken along lines 11—11 of FIG. 10.
Figure 12:
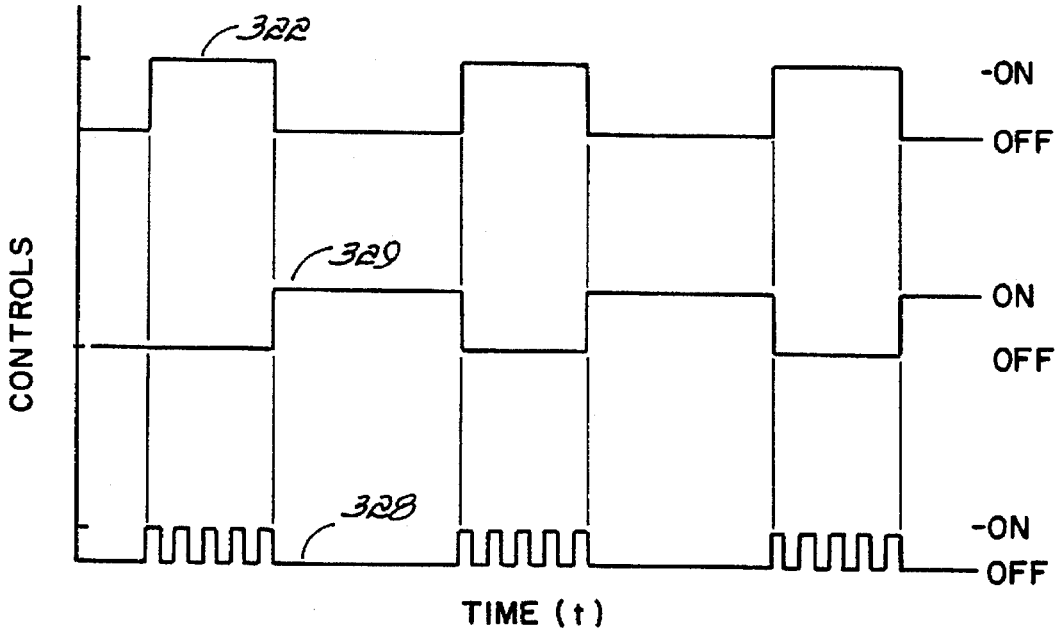
FIG. 12 is a graph which illustrates the ON/OFF sequence for components of the powder coating system shown in FIG. 10.

FIGS. 10–12 relate to a fourth preferred embodiment of the invention, which varies somewhat from the third preferred embodiment, but still provides reverse pulsing during the pumping of powder and reverse flow when the pump is idle. FIG. 10 shows a powder coating system 310 which sprays powder in a spray pattern 318 onto an article to be coated 309. If desired, the article 309 may be carried on a conveyor 301 and/or coated within an environmentally controlled enclosure 302 wherein oversprayed powder would be collected and possibly returned to hopper 314. The apparatus 310 conveys fluidized powder from hopper 314, through a pump body 312, through an outlet line 317 to an electrostatic spray gun 316, such as a Model NPE-4AH, available from Nordson Corporation, Amherst, Ohio, and shown in U.S. Pat. No. 4,630,777, which is hereby incorporated by reference in its entirety. The hopper 314 includes a fluidizing plate 315 above an air plenum 321. Air supplied into the plenum 321 via inlet 350 passes upwardly through the plate 315 to fluidize the powder particles within hopper 314. A paddle 354 is mounted within hopper 314 and rotated via motor 355 to uniformly mix the powder particles.

Particles are drawn from the hopper 314 into the pump body 312 via venturi action caused by operation of an ejector nozzle 322 mounted to the pump body 312 and directed at outlet line 317. To get to the pump body 312, the particles move through a powder inlet 320, which is preferably located directly below rotating paddle 354. As shown in FIG. 11, pump body 312 further includes a pulse nozzle 328 directed at the hopper 314 and along powder inlet 320, and a flow nozzle 329 which is also directed at the hopper 314 along the powder inlet 320. Thus, this fourth preferred embodiment of the invention differs from the third preferred embodiment in that separate nozzles, i.e., nozzles 328 and 329, are used for the separate functions of reverse pulsing inlet 320 during pumping, and reverse flow to prevent the particles from entering inlet 320 when the pump is idle, respectively. This is in contrast to the single nozzle 228 which was used with two separate solenoid valves 238*a* and 238*b* and fluid lines 230*a* and 230*b* in the third preferred embodiment for these same two functions.

FIG. 10 also clearly shows outlet line 317 extending horizontally from pump body 312, without any horizontal or vertical bends, except for the downward bend before gun 316, and is located either level with or entirely below the outlet of pump body 312. Also, spray gun 316 is oriented vertically and located below the outlet of pump body 312. This structure eliminates the possibility of powder particles returning to the pump body 312 under gravitational forces when the ejector nozzle 322 is switched off. The gun 316 is also oriented vertically to further reduce the possibility of collisions and/or coherence of the powder particles during flow from pump body 312 to the spray nozzle of gun 316. In total, the flow path makes only one turn between pump body 312 and the article 309.

FIG. 11 shows the relative positions of the nozzles 328 and 329 with respect to nozzle 322. Use of the two separate nozzles, 328 and 329, for the separate functions of pulsing and stoppage, respectively, produces more precision in these controls and further allows the flows emanating from these nozzles to be oriented in a manner which does not interfere with the spray from nozzle 322.

FIG. 12 shows the ON/OFF timing operation of the sprays from nozzles 322, 328 and 329. Air flow from these nozzles is controlled in the same manner as described with respect to the third preferred embodiment.

FIG. 10A shows the spray gun 316 in greater detail. Spray gun 316 has a powder flow conduit 370 having an inlet 351 at one end and a spray nozzle 352 at the other end. Preferably, spray nozzle 352 is a slot nozzle having a 0.12 inch wide slot available from Nordson Corporation, Amherst, Ohio as part number 117,158. Conduit 370 is completely unobstructed up to nozzle 352 which defines spray pattern 318. This is facilitated by the use of a charging electrode 360 which is completely external to conduit 370 and nozzle 352. With this spray gun design there are no places within the gun for the powder particles to agglomerate, and this facilitates the consistent, uniform application of powder to articles by means of the system 310 of this fourth embodiment.

In view of the above detailed description of four preferred embodiments, it will be understood that variations will occur in employing the principles of this invention, depending upon materials and conditions, as will be understood to those of ordinary skill in the art.

We claim:

1. A powder coating system comprising:

a powder hopper containing fluidized powder particles;

a pump body having an inlet and an outlet;

an ejector nozzle mounted to the pump body and aimed at the outlet;

means for supplying fluidized powder particles from the powder hopper to the inlet of the pump body, the ejector nozzle adapted to spray pressurized air toward the outlet to transport the powder particles along a flow path which extends from the powder hopper into the pump body via the inlet and then out of the pump body via the outlet;

a second nozzle mounted to the pump body and aimed at the inlet, the second nozzle adapted to spray pulses of air at the inlet in a direction opposite the flow of the powder particles along the flow path caused by the ejector nozzle; and a powder applicator device for receiving powder particles from said outlet and spraying the powder particles onto an article to be coated.

2. The powder coating system of claim 1 wherein the ejector nozzle is aligned along a first axis and the second nozzle is aligned along a second axis and the ejector nozzle and the second nozzle are mounted so that the first axis and the second axis do not intersect.

3. The powder coating system of claim 2 wherein the ejector nozzle and the second nozzle are oriented substantially perpendicularly to each other.

4. The powder coating system of claim 1 wherein the air pressure of the ejector nozzle is sufficiently higher than the air pressure of the second nozzle so as to not disrupt the transport of powder particles along the flow path caused by the ejector nozzle.

5. The powder coating system of claim 1 wherein the powder applicator device comprises a spray gun having an external charging electrode.

6. The powder coating system of claim 5 wherein the spray gun has an inlet and a spray nozzle and a straight, unobstructed powder flow passage between the inlet and the spray nozzle.

7. A powder coating system comprising:

a powder hopper containing fluidized powder particles;

a pump body having an inlet and an outlet;

an ejector nozzle mounted to the pump body and aimed at the outlet;

means for supplying fluidized powder particles from the powder hopper to the inlet of the pump body, the ejector nozzle adapted to spray pressurized air toward the outlet to transport the powder particles along a flow path which extends from the powder hopper into the pump body via the inlet and out of the pump body via the outlet, during an "ON" portion of an ON/OFF cycle of operation;

a second nozzle mounted to the pump body and aimed at the inlet, the second nozzle adapted to spray, during an "OFF" portion of the ON/OFF cycle of operation, a flow of gas toward the inlet in a direction which is reverse with respect to the flow of powder particles along the flow path caused by the ejector nozzle, the reverse flow blowing powder particles in the inlet back towards the powder hopper; and a powder applicator device for receiving powder particles from said outlet and spraying the powder particles onto an article to be coated.

8. The powder coating system of claim 7, further comprising:

a controller for controlling the ejector nozzle and the second nozzle to coordinate switching between the "ON" and "OFF" portions of the cycle of operation.

9. The powder coating system of claim 7 wherein the ejector nozzle is aligned along a first axis and the second nozzle is aligned along a second axis and the ejector nozzle and the second nozzle are oriented so that the first and second axes do not intersect.

10. The powder coating system of claim 8 wherein the pump body further comprises;

an outlet portion to which the ejector pump is mounted;

an intake portion to which the second nozzle is mounted; and a connector interconnecting the outlet portion and the intake portion.

11. The powder coating system of claim 5 wherein the ejector nozzle pressure is greater than the second nozzle pressure.

12. The powder coating system of claim 7 wherein the applicator device comprises a spray gun having an external charging electrode.

13. The powder coating system of claim 12 wherein the spray gun has an inlet and a spray nozzle and a straight, unobstructed powder flow passage between the inlet and the spray nozzle.

14. A powder coating system comprising;

a powder hopper;

means for maintaining powder particles in the powder hopper in a fluidized state;

a pump body in communication with the powder hopper, including an inlet therebetween;

an outlet line connected to the pump body wherein the powder hopper, the pump body, the inlet and the outlet line define a flow path for powder particles pumped from the hopper;

an ejector nozzle mounted to the pump body and aimed at the outlet line, the ejector nozzle adapted to spray air through the pump body toward the outlet during an "ON" portion of an "ON/OFF" cycle of operation, thereby to draw powder particles from the powder hopper into the pump body and to pump the powder particles out of the pump body through the outlet line;

means for pulsing an air flow toward the inlet, during the "ON" portion of the cycle of operation;

means for directing a reverse airflow toward the inlet, during an "OFF" portion of the "ON/OFF" cycle; and a powder applicator device for receiving powder particles from the outlet line and spraying the powder particles onto an article to be coated.

15. The powder coating system of claim 14, further comprising:

a single nozzle adapted to spray both the pulsing flow and the reverse flow.

16. The powder coating system of claim 8, further comprising:

a transport nozzle mounted to the pump body along the flow path downstream from the ejector nozzle, the powder particles carried out the outlet line during the "ON" portion by air from the ejector nozzle and the transport nozzle.

17. The powder coating system of claim 14, further comprising:

a controller operatively connected to the ejector nozzle, the means for pulsing and the means for directing a reverse air flow and adapted to control the operation thereof during the "ON" and "OFF" portions of the cycle.

18. The powder coating system of claim 14, further comprising:

a spray gun located at an end of the outlet line, the outlet line extending horizontally from the pump body and the gun located below the outlet line.

19. The powder coating system of claim 14 wherein the inlet is located below the powder hopper and further comprising:

a rotatable stirring member located in the powder hopper above the inlet.

20. The powder coating system of claim 14, further comprising:

means for electrostatically charging the powder particles as the powder particles exit the outlet line toward an article to be coated.

21. The powder coating system of claim 14 wherein the means for pulsing further comprises a first nozzle directed toward the inlet and the means for directing a reverse flow comprises a second nozzle directed toward the inlet.

22. The powder coating system of claim 14 wherein the applicator device comprises a spray gun having an external charging electrode.

23. The powder coating system of claim 22 wherein the spray gun has an inlet and a spray nozzle and a straight, unobstructed powder flow passage between the inlet and the spray nozzle.

24. A powder coating method comprising the steps of:

fluidizing powder particles within a powder hopper;

providing a pump body in fluid communication with the powder hopper;

spraying air from an ejector nozzle toward an outlet of the pump body, thereby causing a flow of powder particles to move from the powder hopper through an inlet to the pump body and to be pumped outwardly from the outlet in a first direction, along a flow path;

pulsing air from a second nozzle toward the inlet, the pulsed air flowing in a direction opposite to the flow of powder particles along the flow path caused by the ejector nozzle;

delivering powder particles from the outlet to a powder applicator device; and spraying powder particles from the powder applicator device onto an article to be coated.

25. The method of claim 24 wherein the air sprayed from the ejector nozzle is sprayed at a first pressure and the air pulsed from the second nozzle is pulsed at a second pressure, and the second pressure is less than the first pressure.

26. The method of claim 24 wherein the ejector nozzle is aligned along a first axis and the second nozzle is aligned along a second axis and the ejector nozzle and the second nozzle are aimed so that the first axis and the second axis do not intersect.

27. A powder coating method comprising the steps of:

fluidizing powder particles within a powder hopper;

providing a pump body in fluid communication with the powder hopper;

spraying air from an ejector nozzle toward an outlet of the pump body during an "ON" portion of an "ON/OFF" cycle of operation, thereby pumping a flow of powder particles from the powder hopper through an inlet to the pump body and out the outlet in a first direction, along a flow path; and spraying air from a second nozzle toward the inlet in a direction opposite to the flow of powder particles along the flow path caused by the ejector nozzle, during an "OFF" portion of the "ON/OFF" cycle of operation;

delivering powder particles from the outlet to a powder applicator device for coating an article to be coated.

28. The powder coating method of claim 27, further comprising the step of:

spraying transport air into the flow path during the "ON" portion of the cycle of operation, the transport air being added to the flow path downstream of the spray from the ejector nozzle.

29. The powder coating method of claim 27, further comprising the step of:

pulsing air toward the inlet in a direction opposite to the flow of powder particles along the flow path caused by the ejector nozzle during the "ON" portion of the cycle of operation.

30. The powder coating method of claim 29 wherein the pulsing air is also sprayed from the second nozzle.

31. The powder coating method of claim 29 wherein the pulsing air is sprayed from a third nozzle.

32. The powder coating method of claim 29 wherein the pulsing air is sprayed from a pulse nozzle, and further comprising the step of:

controlling operation of the ejector nozzle, the second nozzle and the pulse nozzle by a controller which simultaneously sprays air from the ejector nozzle and the pulse nozzle during the "ON" portion of the cycle and then terminates the air flow from both nozzles, and sprays air from the second nozzle during the "OFF" portion of the cycle.

33. The powder coating method of claim 27 and further comprising the step of:

stirring the powder particles with a rotating member while in the powder hopper.

34. The powder coating method of claim 27 wherein the outlet further comprises an outlet line connected to the powder applicator device, the powder applicator device located below the outlet.

35. The powder coating method of claim 34 wherein the powder applicator device is vertically oriented with respect to the outlet line.

36. The powder coating method of claim 34 wherein the outlet line extends substantially horizontally from the pump body.

37. The powder coating method of claim 27 further comprising the step of electrostatically charging the powder particles by means of the applicator device.

38. The powder coating method of claim 37 wherein during the electrostatic charging step the powder particles are charged by an electrode positioned outside of the flow path of the powder applicator device.

39. The powder coating method of claim 38 wherein the powder particles are passed through a powder flow passage of the applicator device which is straight and unobstructed between the inlet to the device and the spray nozzle on the device.

40. A powder coating system comprising:

a powder hopper containing fluidized powder particles;

a pump body having an inlet and an outlet, wherein the inlet of the pump body opens to the powder hopper to place the pump body and the powder hopper in fluid communication;

an ejector nozzle mounted to the pump body and aimed at the outlet, the ejector nozzle adapted to spray pressurized air toward the outlet to transport the powder particles along a flow path which extends from the powder hopper into the pump body via the inlet and then out of the pump body via the outlet;

a second nozzle mounted to the pump body and aimed at the inlet, the second nozzle adapted to spray pulses of air at the inlet in a direction opposite the flow of the powder particles along the flow path caused by the ejector nozzle; and a powder applicator device for receiving powder particles from said outlet and spraying the powder particles onto an article to be coated.

41. The powder coating system of claim 40 wherein the powder hopper has walls and a bottom fluidizing plate, and the powder particles contained in the powder hopper reside within an internal volume defined by the walls and the fluidizing plate, wherein the inlet of the pump body does not protrude into the internal volume of the powder hopper.

42. The powder coating system of claim 40 wherein the powder hopper has a bottom and the inlet of the pump body opens to the bottom of the powder hopper.

43. The powder coating system of claim 40 and further comprising a fluidizing plate located in the powder hopper which defines a fluidizing air plenum below the fluidizing plate, the powder particles in the powder hopper located above the fluidizing plate, wherein the inlet to the pump body extends through the fluidizing air plenum and terminates at the fluidizing plate, the pump body located below the powder hopper.

44. The powder system of claim 43 and further comprising:

a rotatable stirring member located in the hopper above the inlet.

* * * * *